US010864418B2

(12) United States Patent
Kapheim et al.

(10) Patent No.: US 10,864,418 B2
(45) Date of Patent: Dec. 15, 2020

(54) SPORTS PADDLE WITH IMPROVED HEAD PORTION

(71) Applicant: Wilson Sporting Goods Co., Chicago, IL (US)

(72) Inventors: Robert T. Kapheim, Chicago, IL (US); Scott M. Doyle, Oak Park, IL (US); Terri R. Graham, Wheeling, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 404 days.

(21) Appl. No.: 13/946,246

(22) Filed: Jul. 19, 2013

(65) Prior Publication Data

US 2015/0024879 A1 Jan. 22, 2015

(51) Int. Cl.

| | |
|---|---|
| ***A63B 59/48*** | (2015.01) |
| ***A63B 60/52*** | (2015.01) |
| *A63B 102/08* | (2015.01) |
| *A63B 60/50* | (2015.01) |
| *A63B 60/00* | (2015.01) |

(52) U.S. Cl.

CPC ..... *A63B 59/48* (2015.10); *A63B 60/52* (2015.10); *A63B 60/004* (2020.08); *A63B 60/50* (2015.10); *A63B 2102/08* (2015.10); *A63B 2209/02* (2013.01)

(58) Field of Classification Search

CPC ..... A63B 69/38; A63B 49/00; A63B 49/06; A63B 59/0037; A63B 59/04; A63B 59/185; A63B 2049/0223; A63B 2049/0229

USPC ..... 473/475, 763, 459, 521, 524, 327, 331, 473/527, 553, 537, 27

See application file for complete search history.

(56) References Cited

U.S. PATENT DOCUMENTS

| | | | | |
|---|---|---|---|---|
| D150,805 S * | 8/1948 | Gilbert | D21/731 | |
| 4,065,133 A * | 12/1977 | Gordos | A63B 53/0466 473/327 | |
| 4,262,903 A * | 4/1981 | Naret | A63B 60/14 473/530 | |
| 5,100,144 A * | 3/1992 | Okumoto | A63B 53/04 473/331 | |

(Continued)

OTHER PUBLICATIONS

Paddle Tennis Rules, Aug. 12, 2012 p. 6.*
Paddleball Galaxy Technology, Mar. 26, 2012, p. 3.*
Paddleball Gaxy Specification, Mar. 26, 2012, p. 3.*

*Primary Examiner* — John E Simms, Jr.
*Assistant Examiner* — Rayshun K Peng
(74) *Attorney, Agent, or Firm* — Terence P. O'Brien

(57) ABSTRACT

A sports paddle including a head portion coupled to a handle portion. The head portion includes at least one core layer positioned between first and second face plates. The first and second face plates have first and second outer surfaces, respectively. The head portion defines a plurality of through-head portion holes extending from the first outer surface to the second outer surface and a plurality of grooves extending into the first and second face plates. The head portion can include first and second face plates having first and second outer surfaces, respectively, and the handle portion can include a grip. Each of the first and second outer surfaces can include a roughened region and a generally smooth region. The smooth region of the first outer surface can space apart the grip from the roughened region of the first outer surface.

19 Claims, 10 Drawing Sheets

(56) References Cited

U.S. PATENT DOCUMENTS

| | | | | |
|---|---|---|---|---|
| 5,524,890 | A * | 6/1996 | Kim | A63B 53/04 473/242 |
| 5,618,041 | A * | 4/1997 | Huang | 473/549 |
| 6,048,277 | A * | 4/2000 | Raymond | 473/331 |
| 8,282,514 | B2 | 10/2012 | Kapheim et al. | 473/549 |
| 8,371,968 | B2 * | 2/2013 | Gazzara | A63B 59/48 473/527 |
| 2003/0069096 | A1 * | 4/2003 | Lin | 473/521 |
| 2010/0093459 | A1 * | 4/2010 | Cole et al. | 473/291 |
| 2013/0310192 | A1 * | 11/2013 | Wahl et al. | 473/331 |

* cited by examiner

SPORTS PADDLE WITH IMPROVED HEAD PORTION

FIELD OF THE INVENTION

The present invention relates generally to a sports paddle. In particular, the present invention relates to paddle tennis paddle including improved face plates configured for imparting more spin to the ball, and providing an improved feel.

BACKGROUND OF THE INVENTION

Sport racquets or paddles, such as platform tennis paddles, paddle tennis paddles and padel tennis paddles are well known. Platform tennis is an American paddle sport invented in 1928 in New York, and enjoyed by thousands of people of all ages. It is the only paddle or racquet sport that is frequently enjoyed outdoors in cold weather. The game is typically played on an elevated aluminum deck on a court that is smaller than a tennis court. The deck or base of the court is usually enclosed allowing for a heating system to be positioned beneath the deck. The court is surrounded by a 12 foot high, taut wire fencing which allows play off the walls, as in racquetball and squash.

Paddle tennis, which also originated in New York, has existed for over a hundred years. Paddle tennis is a game derived from tennis and played on court that is smaller than a conventional tennis court. Paddle tennis courts are constructed in a manner similar to tennis courts, and can also exist on hard beach sand. Unlike platform tennis, paddle tennis does not require fencing positioned about the court. Paddle tennis is played with a depressurized tennis ball and an underhand serve. The smaller court size adds a strong emphasis and advantage to net play and creates a fast and reaction-based game.

Pádel tennis (or just pádel) is a paddle sport similar to paddle tennis. It was invented in Acapulco, Mexico in 1969 and played extensively in Spain and Latin America. The court is about half the size of a tennis court and includes walls, which like platform tennis are in play.

Sports paddles for platform tennis, paddle tennis and panel tennis are constructed with a rigid rounded planar head portion connected to a handle portion. The head portion is unstrung and typically includes aerodynamic holes extending therethrough. A handle portion is typically coupled to the head portion. Platform tennis is played with a rubber ball, and paddle tennis and pádel tennis are played with a depressurized tennis ball. The balls are highly resilient. The head portion of platform tennis paddles and paddle tennis paddles typically include a roughened texture to improve the ability of the player to impart spin on to the ball. Pádel tennis paddles can also be produced with a roughened texture. The ability to impart spin onto the ball is critical for highly skilled players. Accordingly, there is a continuing need to provide a paddle design that enables a player to more easily impart spin onto the ball and/or to impart a greater amount of spin onto the ball.

Since platform tennis is played in cold weather, many players play platform tennis with gloves. However, many other players play without gloves. Some seek an improved feel or a better grip of the paddle. Others find that heat generated during play, and/or the heat generated from the court heaters is sufficient to keep their hands warm. The handle of platform tennis paddles accommodates a player's hand, but does not typically accommodate both hands of the player entirely. Accordingly, when a player plays without gloves and attempts any form of two-handed shot, they often will contact the roughened portion of the platform paddle. Repeated contact with the roughened texture can lead to irritation, abrasions, cuts, and other injuries. In fact, some players play with bandages on their fingers due to such injuries. Accordingly, a need exists for making a platform tennis paddle that can be used without gloves for two-handed shots without causing irritation or injury to the player.

It would be advantageous to provide a paddle with an improved face plate or striking surfaces for imparting more spin to the ball and without causing irritation or injury to the player.

SUMMARY OF THE INVENTION

The present invention provides a sports paddle including a head portion coupled to a handle portion. The head portion includes at least one core layer positioned between first and second face plates. The first and second face plates have first and second outer surfaces, respectively. The head portion defines a plurality of through-head portion holes extending from the first outer surface to the second outer surface and a plurality of grooves extending into the first and second face plates.

According to a principal aspect of a preferred form of the invention, a sports paddle extends about a longitudinal axis. The paddle includes a generally planar head portion coupled to a handle portion. The head portion includes opposing first and second face plates having first and second outer surfaces, respectively. Each of the first and second outer surfaces includes a roughened region and a generally smooth region. The head portion has a rounded shape and a head size within the range of 70 to 100 square inches. The head portion defines a plurality of through-head portion holes extending from the first outer surface to the second outer surface. The handle portion includes a grip. The smooth region of the first outer surface spaces apart the grip from the roughened region of the first outer surface. The smooth region of the first outer surface has a first longitudinal dimension measured with respect to the longitudinal axis within the range of 1 to 3 inches.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
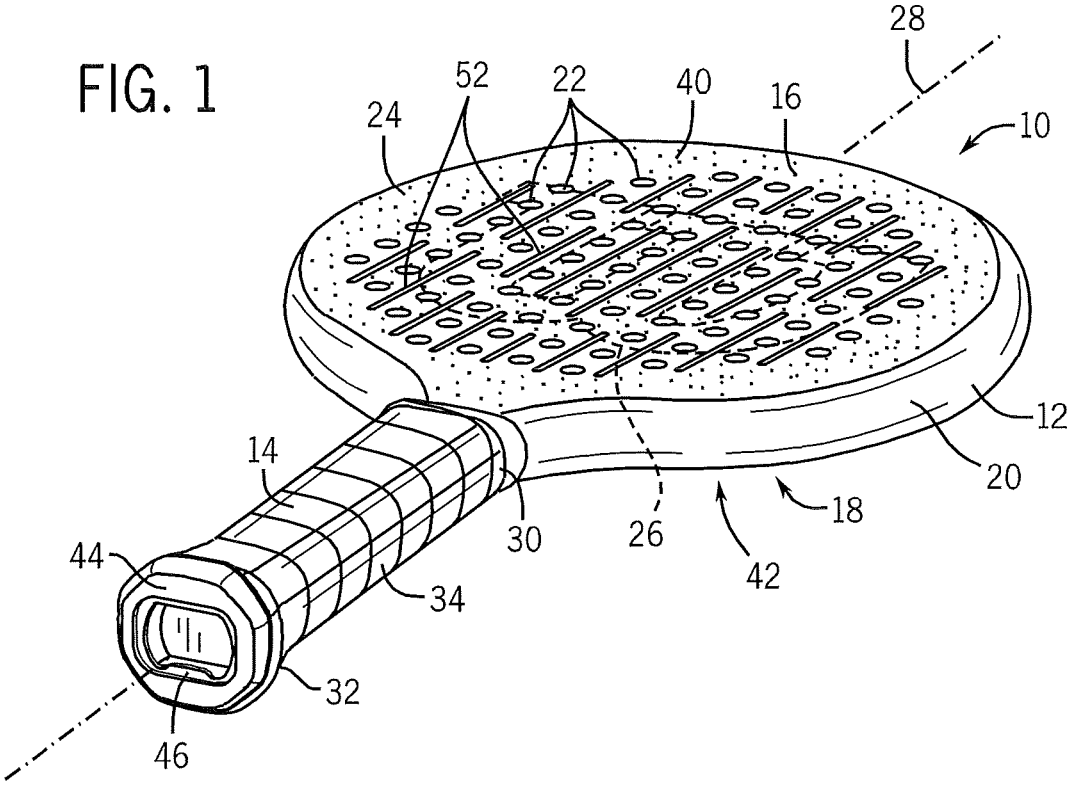
FIG. 1 is a front, end perspective view of a sports paddle in accordance with a preferred embodiment of the present invention.

Referring to FIG. 1, a sports paddle or racquet is indicated generally at 10. The racquet 10 of FIG. 1 is configured as a platform tennis paddle, however, the invention can also be formed as other types of sports paddles, such as, for example, a paddle tennis paddle, a padel tennis paddle, a table tennis paddle and beach paddles. The platform tennis paddle 10 has a construction that is similar to the construction of a paddle tennis paddle and a padel tennis paddle. The characteristics of the platform tennis paddle 10 discussed below are directly applicable to paddle tennis paddles and padel tennis paddles.

In a preferred embodiment, the paddle 10 a length of approximately 18 inches, and preferably has a length within the range of 15 to 18 inches. In other implementations, other lengths can be used. The paddle 10 includes a head portion 12 coupled to a handle portion 14. The head portion 12 is a rigid planar structure having a rounded shape and configured for impacting a game ball. The head portion 12 includes first and second opposing planar surfaces 16 and 18 and an edging 20. In a preferred embodiment, the head portion 12 has a thickness measured from the first planar surface 16 to the second planar surface 18 of approximately 0.7 inches. In alternative preferred embodiments, the head portion can be formed of other thicknesses. The rounded shape of the head portion 12 defines a head size. In preferred implementations, the head size of the head portion 12 is within the range of 70 to 100 square inches. In other implementations, other head sizes can be used. The head portion 12 preferably includes a plurality of through-head portion holes 22 perpendicularly extending from the first planar surface 16 to the second planar surface 18. The holes 22 are spaced apart from each other and facilitate the swinging of the paddle 10 by enabling air to flow through the head portion 12 during use. In one implementation, the head portion 12 can include 87 holes, each with a diameter of approximately 0.375 inch. In another implementation, the holes 22 can have a diameter of approximately 10 millimeters. In other implementations, the head portion 12 can include a number of through-head portion holes within the range of 45 to 87 holes. In still other implementations, other numbers and sizes of holes can be used.

The first and second planar surfaces 16 and 18 can include a roughened texture 24. The roughened texture 24 can be formed by grit, sand or other particles applied to, or positioned under one or more coatings applied to, the first and second planar surfaces 16 and 18. Alternatively, the roughened texture 24 can result from a surface treatment performed on the first and second planar surfaces 16 and 18. The roughened texture 24 enhances a player's ability to impart a spin or otherwise control the motion of the ball during impact with the head portion 12. In an alternative preferred embodiment, the first and second planar surfaces can be smooth and not roughened or textured. The first and second planar surfaces 16 and 18 can also include alphanumeric and/or graphical indicia 26. The indicia 26 can include one or more of the following items: trademarks, logos, symbols, patterns, designs, instructions, paddle design characteristics, advertisements, playing rules, warnings and combinations thereof.

Figure 2:
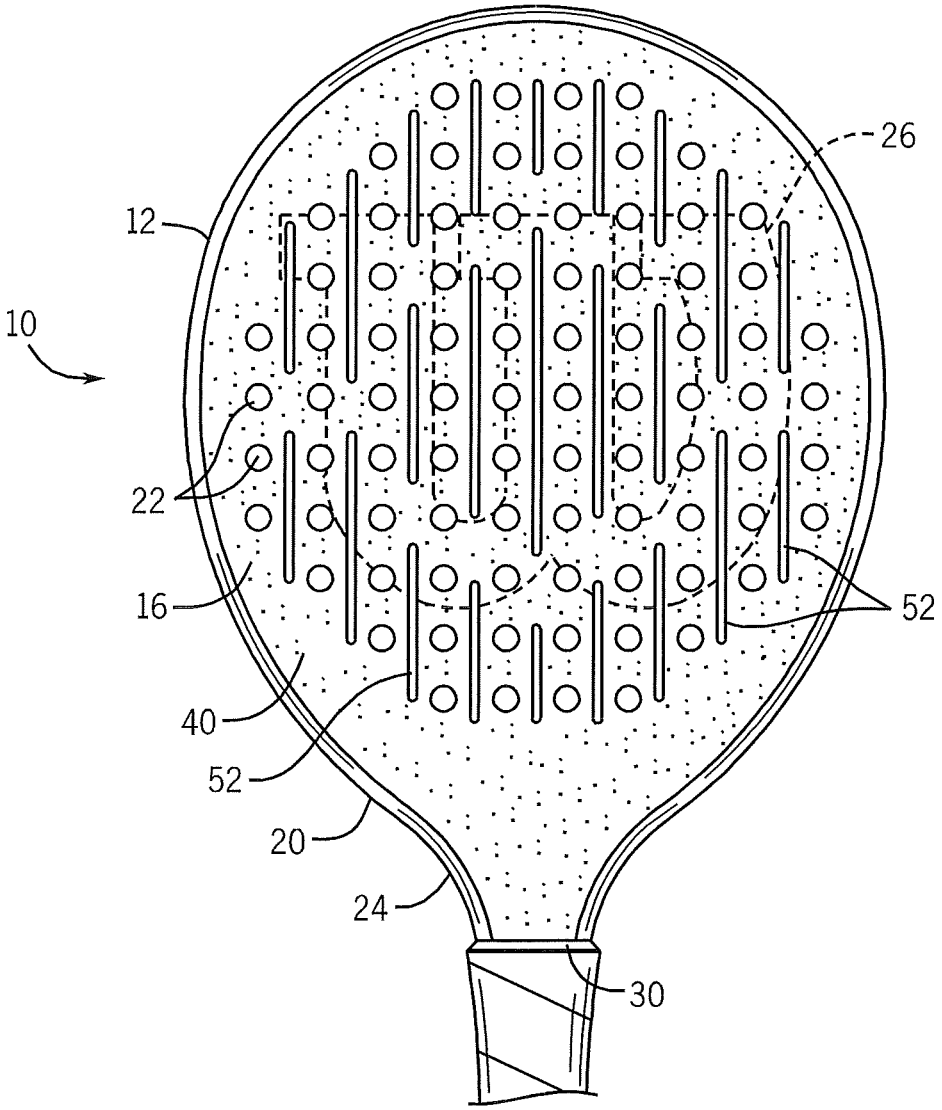
FIG. 2 is a front view of the head portion of the paddle of FIG. 1.
Figure 3A:
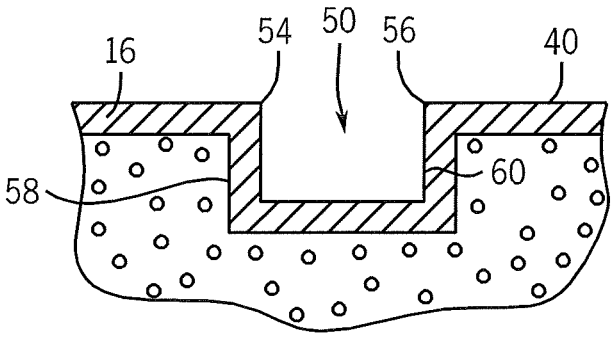
FIG. 3*a* illustrates a sectional view of a portion of the head portion taken about line 3-3 of FIG. 2 illustrating a cross-section profile of a groove.

Referring to FIGS. 1, 2 and 3*a*, the head portion 12 can be formed of one or more core layers 70 sandwiched between first and second face plates 40 and 42 having the first and second planar outer surfaces 16 and 18. The at least one core layer 70 is preferably formed of a lightweight, durable closed cell foam material, such as for example, ethylene vinyl acetate (EVA). In other implementations, other materials for the at least one core layer can be used, such as, for example, a polyurethane, a rubber, polyethylene, polyvinyl chloride, a polyethylene vinyl acetate, other lightweight elastic foams, and combinations thereof. The EVA can be formed with varying amounts of foaming agents to provide different levels of hardness and/or density to the core layer 70. In one implementation, the EVA foam of the core layer 70 can have a hardness within the range of 20 to 60 when measured on a Shore E hardness scale. In other implementations, the core layer can have other hardness values. In another implementation, the at least one core layer can include three core layers, with a first core layer positioned between two outer core layers 70 (see FIG. 3*d*), and the first, inner core layer can be formed of a material having a lower hardness reading than the outer core layers. In another implementation, the opposite configuration of hardness can be used with the outer layers being formed of a harder material than the inner layer or layers. In still other implementations, open cell or non-cellular materials can be used to form one or more of the core layers.

The first and second face plates 40 and 42 are preferably formed of a strong durable material, such as, for example, a fiber composite material. As used herein, the term "fiber composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In multiple layer constructions, the fibers can be aligned in different directions with respect to a longitudinal axis 28 of the paddle 10, and/or in braids or weaves from layer to layer. The fibers are formed of a high tensile strength material such as carbon. Alternatively, the fibers can be formed of other materials such as, for example, glass, graphite, boron, basalt, carrot, flax, Kevlar®, Spectra®, poly-para-phenylene-2,6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers. In alternative embodiments, the head portion 12 can be formed of other materials such as, for example, a thermoset material, a thermoplastic material, aluminum, other metals, wood, and combinations thereof.

The edging 20 preferably extends about the periphery of the head portion 12 between the first and second planar surfaces 16 and 18. The edging 20 can be integrally formed as part of the head portion 12 or can be applied to the head portion 12 as a separate structure. The edging 20 can have a thickness (or width) that is equal to the thickness of the head portion 12 measured from the first planar surface 16 to the second planar surface 18. Alternatively, thickness of the edging 20 can extend approximately 0.125 inch beyond the first planar outer surface 16 and the second planar outer surface 18. The edging can also overlap or extend over a portion of the first and second planar surfaces 16 and 18 by 0.5 inch or less from the periphery of the head portion 12. In other implementations, the overlap of the edging onto one or both of the outer surfaces can extend beyond 0.5 inch. The edging 20 is preferably formed of a tough, durable material, such as, a fiber composite material. The edging 20 can be formed through bladder molding wherein a long, thin bladder extends around the outer periphery of the one or more core layers of the head portion 12. The two ends of the bladder can be brought together to facilitate the forming of the handle portion 14. One or more plies or layers of fiber composite material can then be laid up or wrapped around the bladder, or around the outer portion of the bladder and a portion of the first and/or second face plates 40 and 42. Alpha-numeric and/or graphical indicia can also be applied to the outer surface of the edging. Alternatively, the edging 20 can be formed of other durable materials, such as for example, other plastic materials, a rubber, a thermoset material, a thermoplastic, a metallic alloy, wood and combinations thereof. The edging 20 can provide a flat, convex or concave contour to the side or periphery of the head portion 12. The edging 20, the one or more core layers, and the first and second face plates 40 and 42 are placed into a mold, and molded and cured to produce a frame of the paddle 10. The molded frame can also include a hairpin or a pallet of the handle portion 14.

The handle portion 14 is a longitudinal tubular structure having a distal end 30 and proximal end 32. The distal end 30 of the handle portion 14 is coupled to the head portion 12. The handle portion 14 can include a grip 34 to enhance the ability of a player to grasp, hold and manipulate the paddle 10. The handle portion can further include a butt cap 44 and the butt cap 44 can include a bottle opener 46. The butt cap 44 can be coupled to the proximal end 32. In one implementation, the butt cap 44 can be directly adhesively bonded to the proximal end 32. In an alternative implementation, the butt cap can be thermally bonded, mechanically fastened, or otherwise directly attached to the proximal end.

In one preferred embodiment, the handle portion 14 can be integrally formed with and connected to the head portion 12 to form a one piece frame. In one implementation, the bladder molding used to form the rim 20 is used to form a hair pin or pallet of the handle portion 14 formed of the fiber composite material. The one implementation, a polyurethane foam, or other foam, can be applied to the hair pin to from a foamed pallet for receiving the grip 34. In another implementation, the fiber composite material can be molded to form the pallet that receives the grip 34. In another implementation, the handle portion 14 can be formed separate from and coupled to the distal end 30 of the handle portion 14. The handle portion 14 is configured for grasping by one or more hands of a user during play. The handle portion 14 can be formed of one or more materials such as a carbon-fiber composite material. Alternatively, the handle portion 14 can be formed of other materials such as other composite materials, aluminum, other metallic alloys, wood, a polyurethane foam, a thermoplastic material, a thermoset material and combinations thereof.

At least one of the first and second face plates 40 and 42 can include or define a plurality of grooves 50. The grooves 50 are elongate channels or recesses formed into the first and/or second face plates 40 and 42. First and second groove sidewalls 58 and 60 can engage the first or second outer surface 16 or 18 of the head portion 12 to form first and second edges 54 and 56, respectively. The grooves 50 formed into the first and/or second face plates 40 and 42 improve the ability for a player to impart spin onto a ball upon hitting the ball during a swing of the paddle. The first and second edges 54 and 56 can engage the ball and impart a spin to the ball. The grooves 50 can number 2 or more. In one implementation, the grooves 50 extend parallel to the longitudinal axis 28 of the paddle 10. The grooves 50 can be formed of any length. In one set of implementations, the length of the grooves can be within the range of 0.5 to 10 inches. The lengths of the grooves 50 can vary from one to another on the same face plate or can all be formed of the same length. The grooves 50 can be spaced apart from each other.

The through-head portion holes 22 formed in the head portion 12 define a central region 52 of the first and second face plates 40 and 42. The central region 52 can be defined by a single closed curved shape that extends encloses all of the holes 22. In one implementation, the grooves 50 can be sized and positioned to extend only within the central region 52. The grooves 50 of the preferred embodiment of FIG. 2 are positioned entirely within the central region 52 with the grooves 50 extending right to the limits of the central region 52. In other implementations, the grooves can extend to a lesser extent within the central region; inside and outside of the central region; or entirely outside the central region.

The grooves 50 further include a width at the first or second outer surfaces 16 or 18 of the first or second face plates 40 or 42, respectively, and a maximum depth. In one implementation, the width measured from the first sidewall 58 to the second side wall 60 at the first and second edges 54 and 56 can be within the range of 1 to 6 millimeters. In one implementation, the maximum depth of the groove can be within the range of 0.5 to 10 millimeters. In another implementation, the grooves 50 can be formed with a maximum depth within the range of 0.1 to 10 millimeters. In other implementations, other dimensions for the width and maximum depth of the grooves can be used.

Figure 3B:
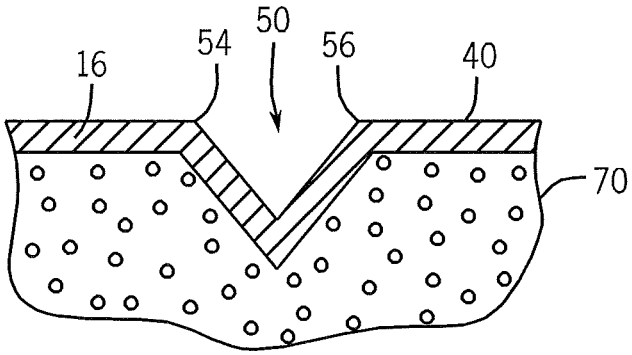
FIGS. 3*b* through 3*d* illustrates sectional views of a head portion of a sports paddle in accordance with alternative preferred embodiments of the present invention.
Figure 3C:
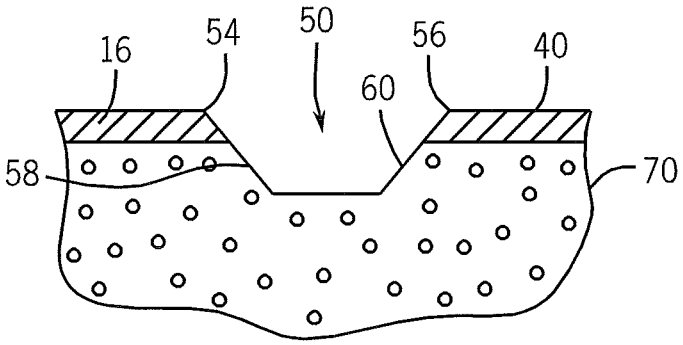
Figure 3D:
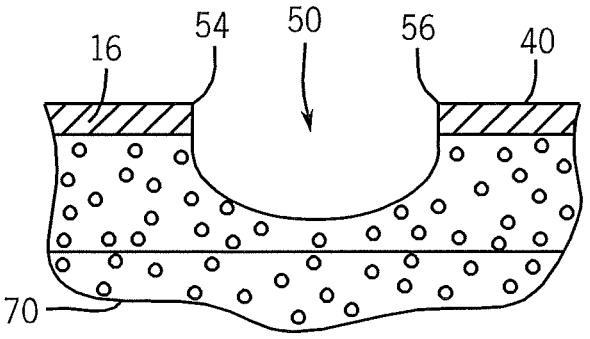

Referring to FIGS. 3*b* through 3*d*, the grooves 50 can be formed in a variety of cross-sectional shapes. In one implementation, the grooves 50 can be generally V-shaped as in FIG. 3*b*. In another implementation, the grooves 50 can have a greater width at the top of the groove 50 and a narrow width at the maximum depth of the groove 50, such as in FIG. 3*c*. The first and second side walls 58 and 60 are angled with respect to the planar first or second outer surfaces 16 or 18. In another implementation, as shown in FIG. 3*d*, the groove 50 can have a generally semi-circular cross-sectional shape. In other implementations, the cross-sectional shape of grooves can have other curved, angled or irregular shapes. A single paddle 10 may have one groove 50 with one cross-sectional shape and other grooves with one or more other cross-sectional shapes. The cross-sectional shape of the grooves 50 can vary the degree in which the grooves 50 engage the ball and provide the ability to customize or optimize the grooves 50 to meet a particular player's skill level or need, a particular application, or to meet a particular rule requirement from a platform tennis association.

Referring to FIGS. 3*a* and 3*b*, the groove 50 can be defined by forming recesses or channels within the fiber composite material making up the face plates 40 and 42. The recesses 50 can be formed by molding into the first and/or second face plates 40 and/or 42. In other implementations, other techniques for forming the grooves into the first and/or second outer surfaces 16 and/or 18 such as embossing can be used. Referring to FIGS. 3*c* and 3*d*, in other implementations, the grooves 50 can be formed by removing some of the fiber composite material forming the first or second face plates 40 or 42 and a portion of the underlying core layer 70. The groove 50 can be formed by milling, cutting, stripping or otherwise removing material from the head portion 12.

Figure 4A:
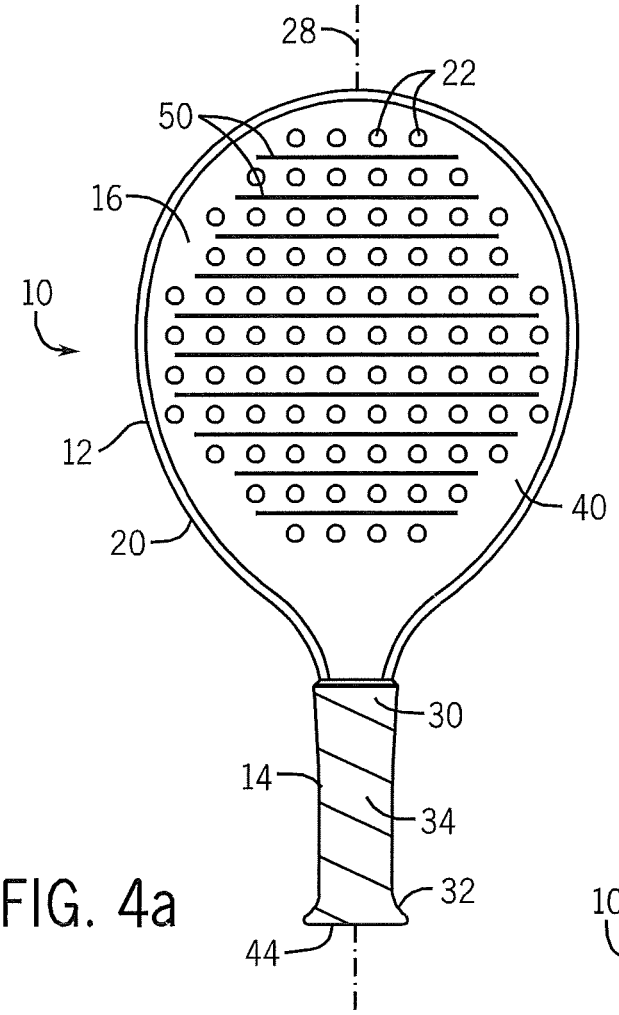
FIGS. 4*a* through 4*h* illustrate front views of a sports paddle in accordance with alternative preferred embodiments of the present invention.
Figure 4B:
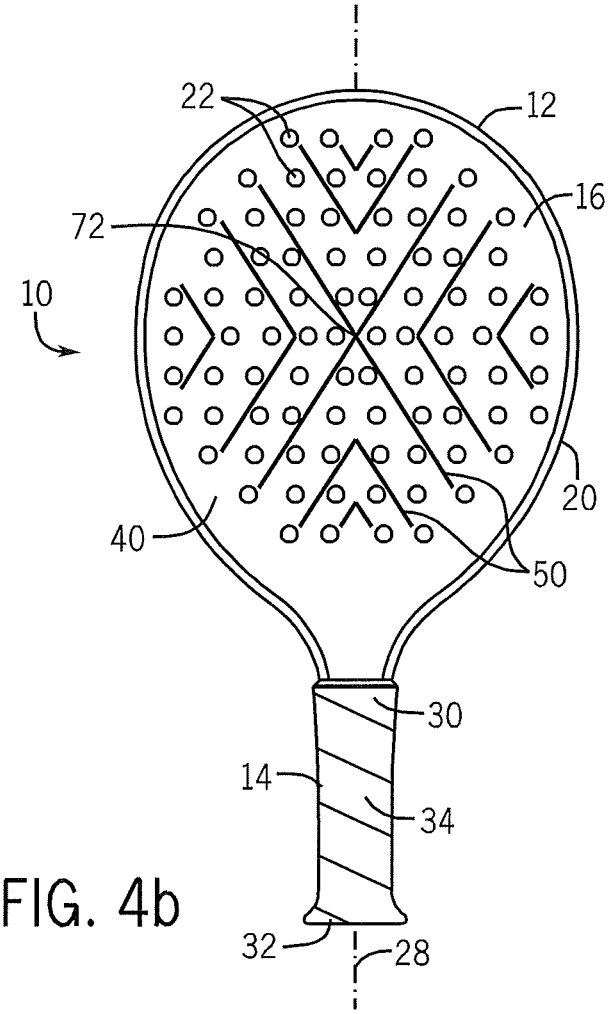
Figure 4C:
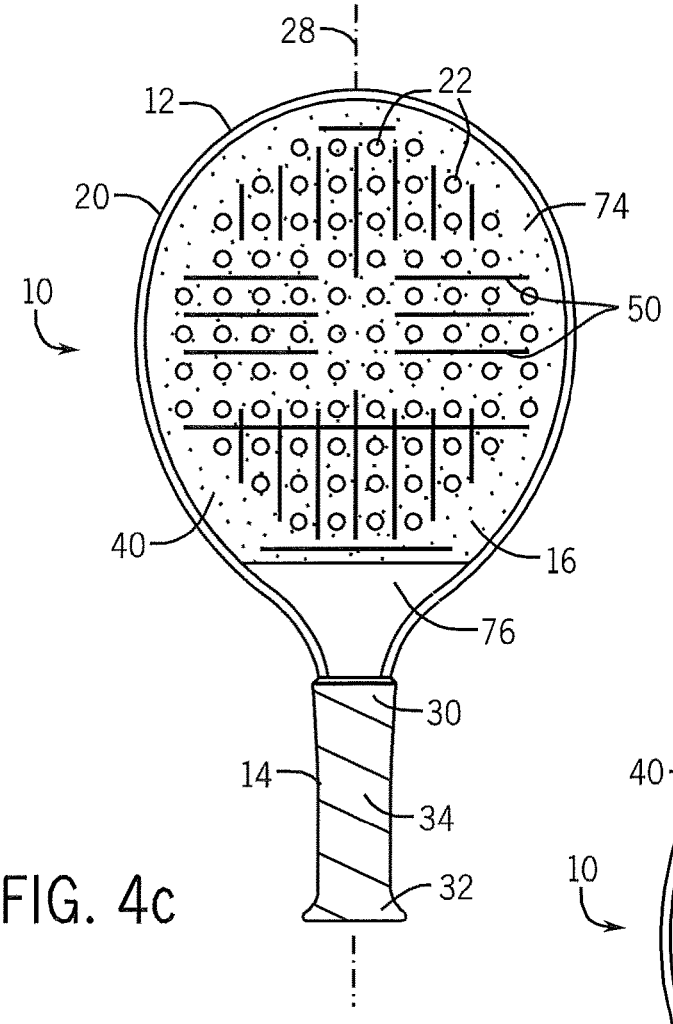
Figure 4D:
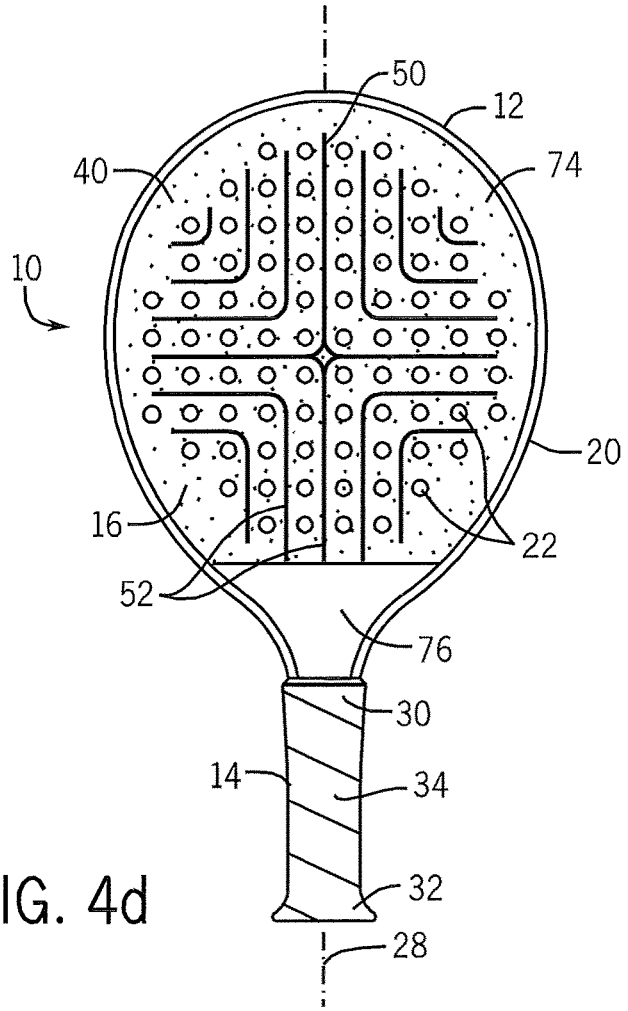
Figure 4E:
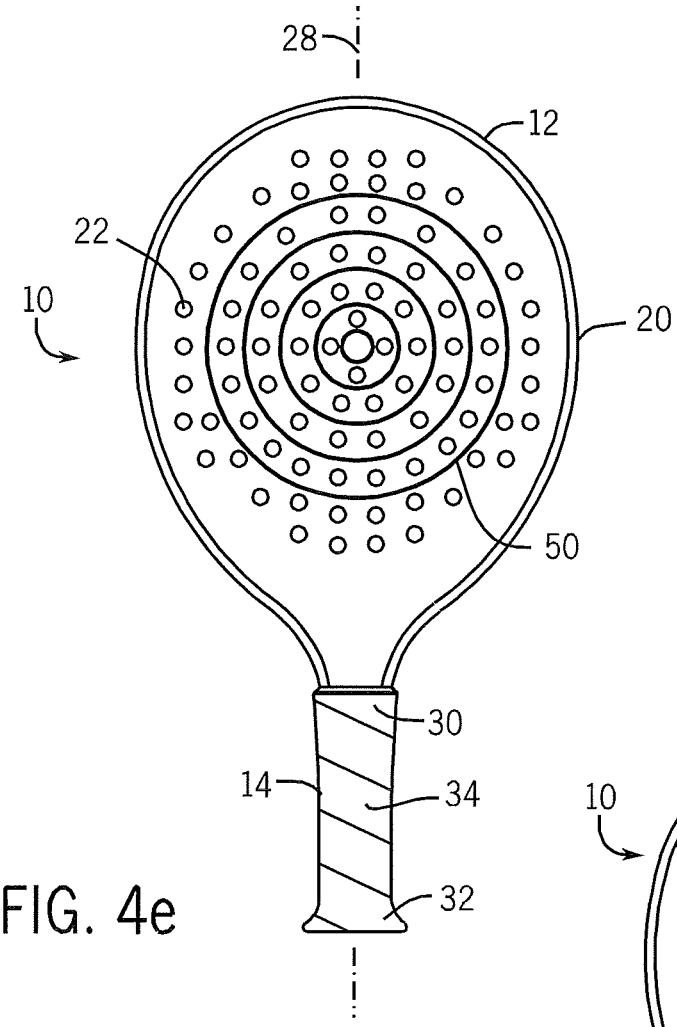
Figure 4F:
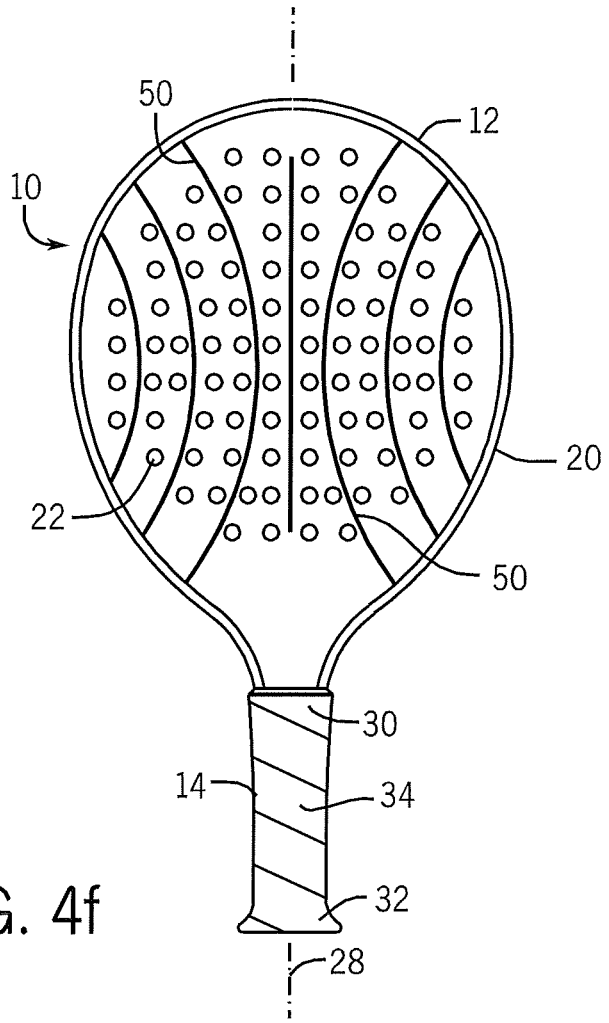
Figure 4G:
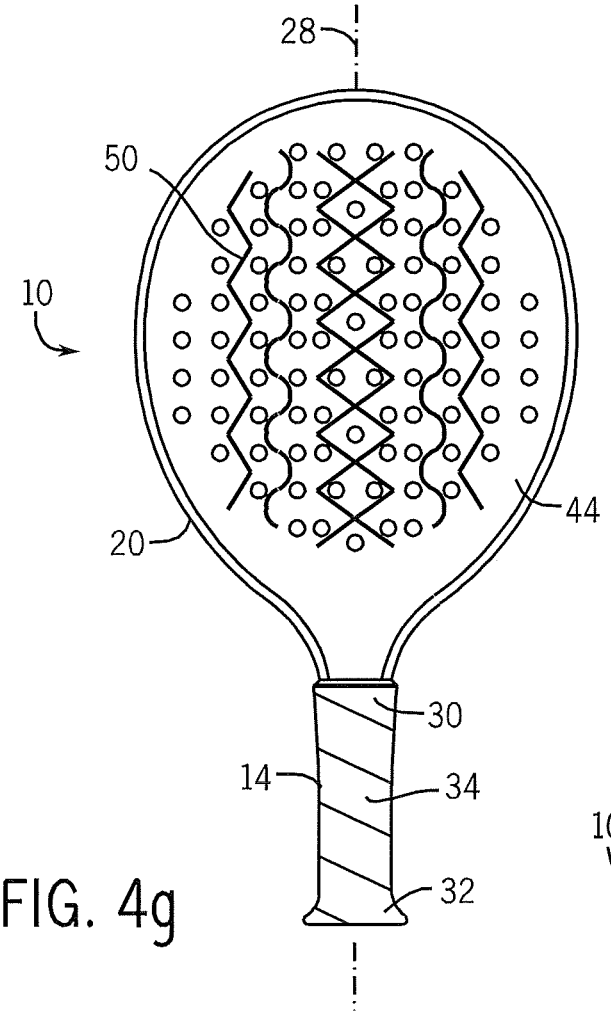
Figure 4H:
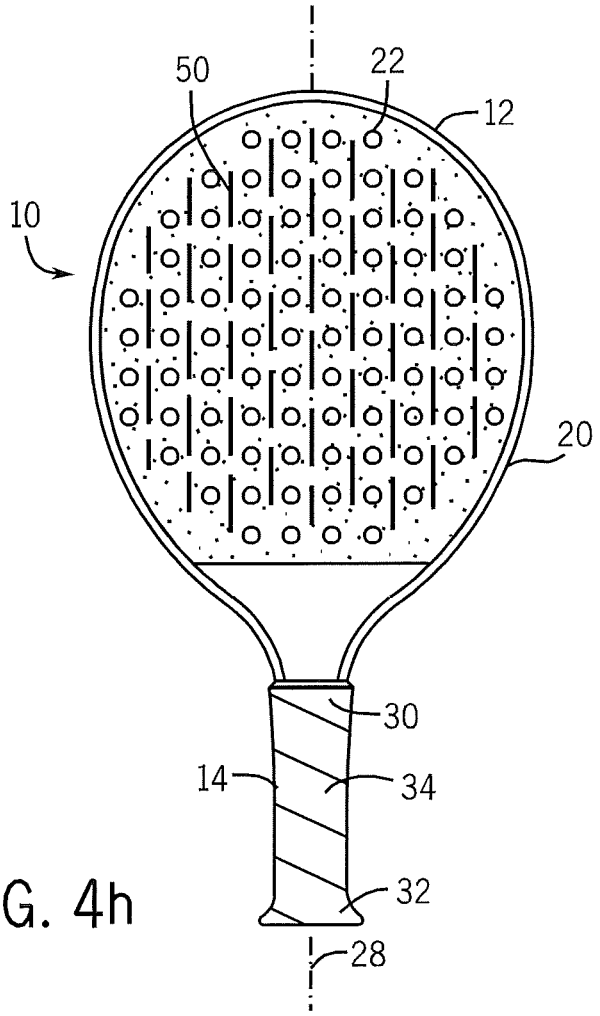

Referring to FIGS. 4*a* through 4*h*, the grooves 50 can be formed into the first and/or second face plates 40 and/or 42 in a variety of different, shapes, and lengths to define a variety of different groove patterns. The grooves 50 can have cross-sectional shapes that match any of the previously described shapes. The grooves 50 can number two or more, and can be spaced apart from each other. Referring to FIG. 4*a*, the grooves 50 can extend in a direction that is orthogonal to the longitudinal axis 28 of the paddle 10. Referring to FIG. 4*b*, the grooves 50 can extend in directions that are angled with respect to the longitudinal axis 28. The grooves 50 can also intersect each other, such as point 72. Referring to FIG. 4*c* in one implementation, the plurality of grooves 50 can include at least one groove 50 extending in a first direction that is parallel to the longitudinal axis 28 and at least one other groove 50 extending in a second direction that is orthogonal to the first direction (and to the axis 28). The grooves 50 can intersect each other, or be spaced apart from each other. Referring to FIGS. 4*d*, 4*e* and 4*f*, the plurality of grooves 50 can form a variety of different patterns on the first or second face plates 40 or 42 including different straight or curved grooves, irregular shaped grooves, circular grooves, sinusoidal grooves, diamond shaped grooves, and combinations thereof. Referring to FIG. 4*g* in one implementation, the plurality of grooves 50 can be a set of very short grooves extending over the first and/or second face plates 40 and/or 42. Other shapes, patterns and combinations of grooves can be used. The pattern formed by the grooves on the first face plate can be different from the pattern formed by the grooves on the second face plate. Alternatively, one of the first or second face plates can be formed without grooves while the other of the first or second face plates includes one of the plurality of groove patterns or combinations described above.

Referring to FIGS. 4*c*, 4*d*, 5 and 6, in one implementation, one or both of the face plates 40 and 42 of the head portion 12 can include a roughened region 74 and a smooth region 76. The roughened region 74 includes the roughened texture 24, and the smooth region 76 is formed with a smooth, non-abrasive surface. The smooth region 74 is generally formed without grit, sand, or other surface preparations to roughen or significantly increase the coefficient of friction of the outer surface 16 or 18. The paddle 10 of the embodiment of FIGS. 5 and 6 can be substantially the same as the previously disclosed embodiments or implementations, with the exception of the roughened texture 24 not extending into the smooth region 74 one or both of the face plates 40 and 42. The smooth region 74 is advantageously positioned next to the handle portion 14 and is sized to have a longitudinal dimension of at least 1 inch measured with respect to the longitudinal axis 28 of the paddle 10. The smooth region 76 can space apart the roughened region 74 from the handle portion 14 and from the grip 34.

Figure 6:
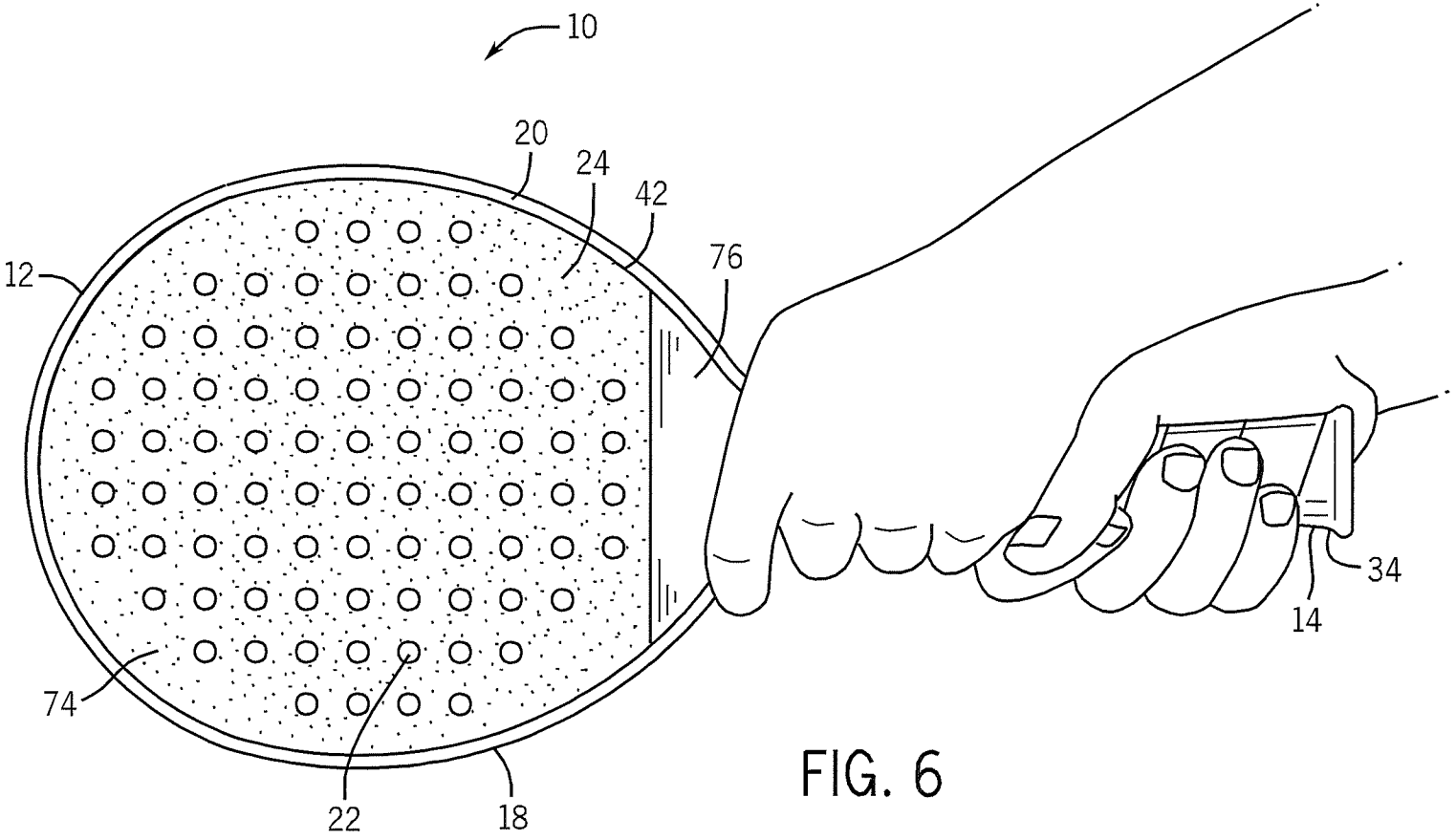
FIG. 6 is a back view of the paddle of FIG. 4 being gripped by two hands of a user.

As discussed in the background of the invention, the grip 34 of the handle portion 14 is typically sufficiently sized for grasping by one hand of the player, and, for players with smaller hands, both hands of the player. Some platform tennis players hold the paddle with a single hand for all shots including serves, forehands, backhands, volleys and overhead shots. However, many players use two hands to perform at least one type of platform tennis shot. For example, many players will use two hands when completing a back hand shot. Some players have hands that are small enough to enable both hands can wrap around the grip 34 of the handle portion 14 when executing two handed shots. However, for those players with normal sized or larger sized hands, executing a two handed shot such as a two-handed backhand shot requires the player to place a significant portion of the palm side of his or her second hand onto one or both of the first and/or second outer surfaces 16 and 18 of the first and/or second face plates 40 and 42. Paddle tennis paddles 10 include the roughened texture 24 over substantially the entire planar face of the first and second outer surfaces 16 and 18. As a result, a player will typically contact the roughened texture 24 of the first and/or second outer surfaces 16 and 18 when executing two-handed shots. Overtime, this contact, particularly upon impact with the ball, can be uncomfortable, irritating and/or distracting to the player. The contact can also cause injury to player's hand including bruising, cuts, abrasions and other injuries. FIG. 6 illustrates a player's hands contacting the smooth region 76 of the face plate 42 to execute a two-handed back hand shot.

If the player is wearing gloves, the risk of injury to the player can be reduced. However, the repeated contact with the abrasive roughened texture 24 can cause the gloves to prematurely wear and wear out. The use of gloves can also lessen the player's ability to feel the impact between the ball and the paddle 10, and/or to properly and firmly grasp the paddle 10. The smooth region 76 can improve the visual appearance of the paddle.

The present invention eliminates these negative issues that can arise when executing two-handed shots with the paddle 10. The incorporation of the smooth region 76 adjacent the distal end 30 of the handle portion 14 and the separation of the roughened region 74 from the handle portion enables the player to securely and confidently grasp the paddle 10 with two hands to perform two-handed shots without irritation, discomfort or premature wear of their gloves or other equipment. A player who chooses not to wear gloves when playing platform tennis can maintain his or her focus on the game and not have to be concerned with injury or discomfort due to contact with the roughened texture 24 of the head portion 12. Further, a player who chooses to play with gloves does not have to worry about premature wear or failure of his or her gloves due to repeated contact with the roughened texture 24 of the face plates 40 and 42.

Figure 5:
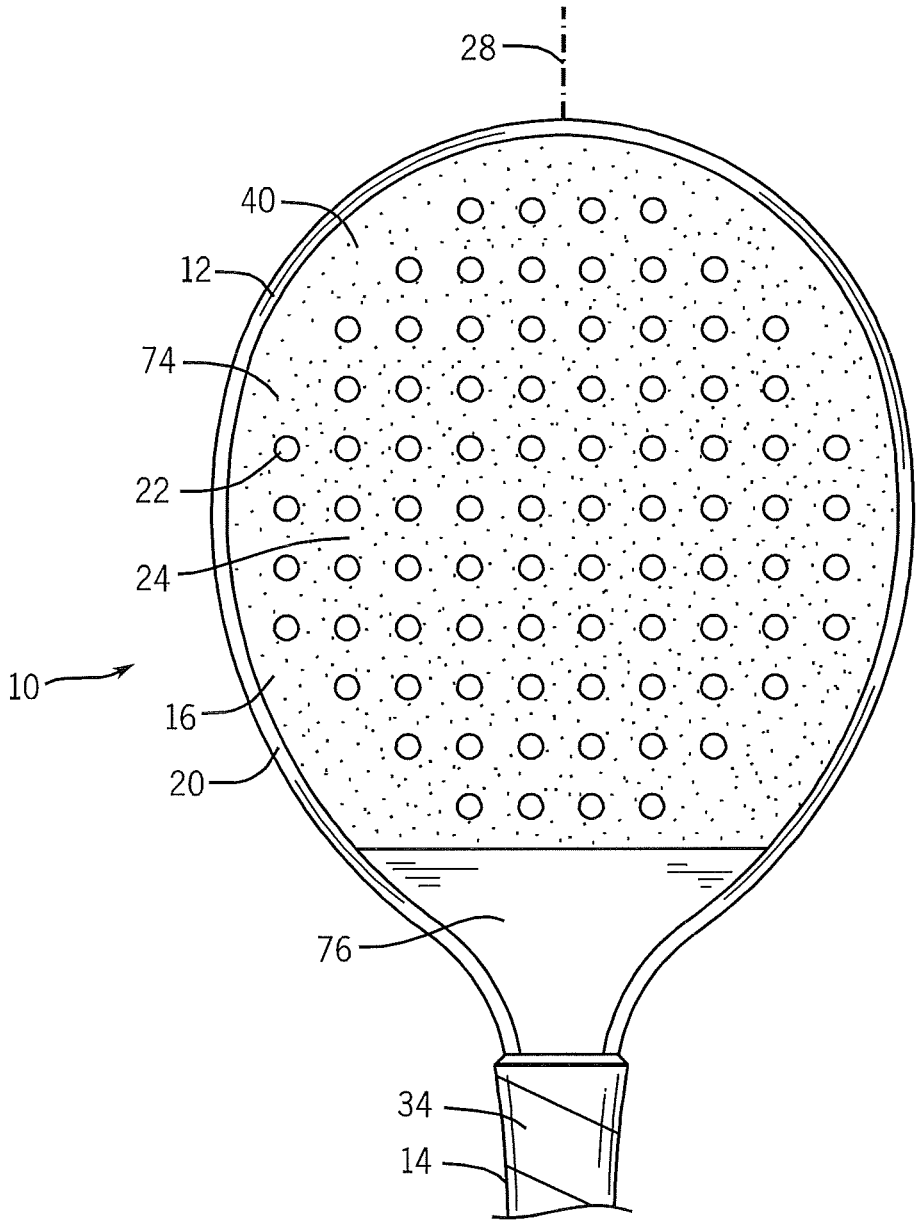
FIG. 5 is a front view of a sports paddle in accordance with another alternative preferred embodiment of the present invention.

Referring to FIGS. 4*c* and 4*d* in some implementations, the roughened and smooth regions 74 and 76 of the face plates 40 and/or 42 can be used with the grooves 50. Referring to FIGS. 4*c* and 5, the through-head portion holes 22 can be formed only through the roughened region 74 of the face plates 40 and 42. The roughened region 74 can end or terminate within 0.25 inch (measured with respect to the longitudinal axis 28 of the paddle 10) from the through-head portion hole 22 positioned closest to the handle portion 14. Referring to FIG. 4*d*, in other implementations, the smooth region 76 can extend over a larger portion of the first and/or second face plates 40 and/or 42 including into the central region 52.

Figure 7:
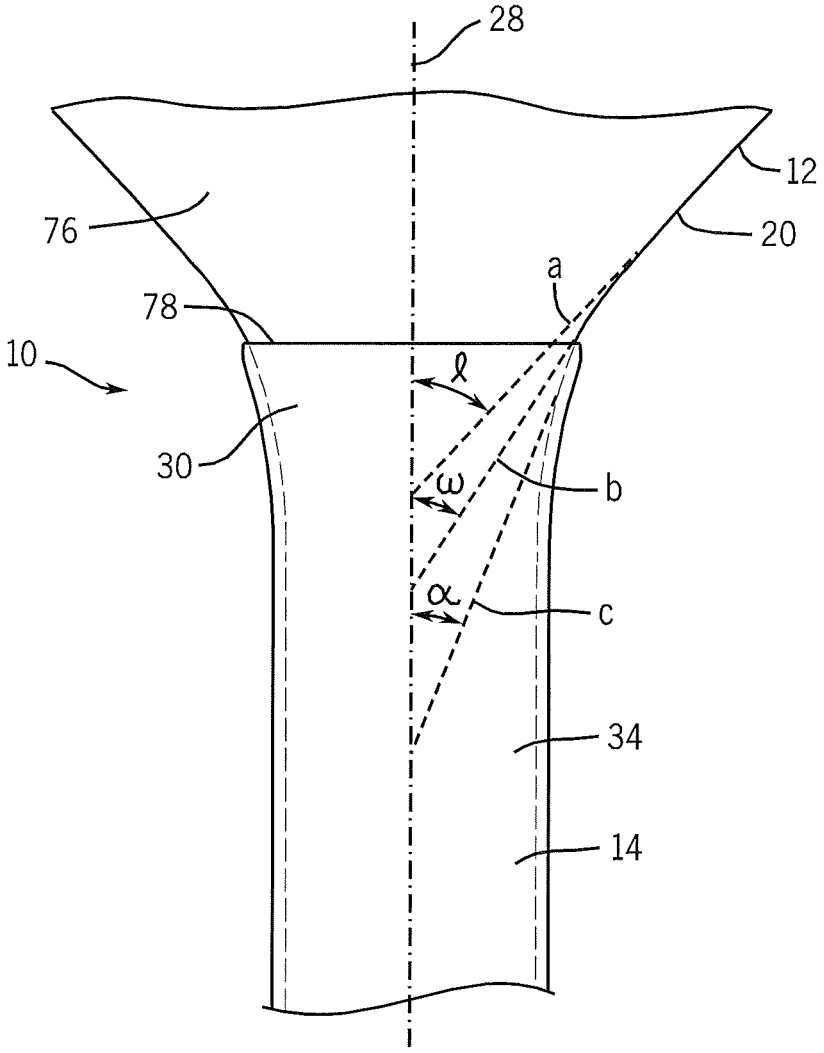
FIG. 7 is a section front view of a sports paddle in accordance with one implementation of the present invention.

Referring to FIG. 7, in many paddle configurations, the head portion 12 is directly connected to the handle portion 14. The grip 34 of the handle portion 14 typically extends over substantially the entire length of the handle portion 14. However, in some instances the grip 34 may not extend to cover the entire distal end 30 of the handle portion 14. In such a configuration, the distance from the grip 34 to the head portion 12 can be significant. Additionally, the head portion 12 is generally rounded and transitions into the handle portion 14 with the edging 20 of each side of the paddle 10 converging or coming closer together toward the handle portion 14. In other configurations, the handle portion 14 can be formed so as to gradually widen toward head portion 12. Accordingly, in some paddle configurations the point where the handle portion 14 ends and the head portion begins can be unclear. For purposes of the present invention, the transition point or line 78 of the paddle 10 occurs either at the distal end of the grip 34 or the location where the angle formed by the longitudinal axis 28 of the paddle 10 and a line extending tangentially to the side of the paddle 10 (the side being the surface that is orthogonal to the face plate) becomes less than 30 degrees, whichever is further from the butt cap end of the paddle 10. In FIG. 7, the angles l and w are greater than 30 degrees. Therefore, the location where the tangential lines a and b contact the side of the paddle 10 is part of the head portion 14. The angle $\alpha$ is 30 degrees or less, and the point where the tangential line c contacts the side of the paddle 10 is considered part of the handle portion 14. In the implementation shown in FIG. 7, the distal end of the grip 34 is further from the butt end of the handle portion 14 and therefore the transition line 78 is defined by the distal end of the grip 34. If the grip was much shorter, then the point where the angle between the longitudinal axis 28 and the tangential line reached 30 degrees would define the transient line or point.

Accordingly, paddles built in accordance with the present invention enable a player to more easily impart spin onto the ball and/or to impart a greater amount of spin onto the ball. When a player can more effectively impart spin to the ball, the player has the ability to hit the ball harder while keeping the ball in play and to more easily get the ball over the net. Paddles built in accordance with the present invention can provide the ability to customize or optimize the grooves to meet a particular player's skill level or need, a particular application, or to meet a particular rule requirement from a platform tennis association. Paddles formed under the present invention are ideal for play in cold weather, with or without gloves. Paddles built in accordance with the present invention provide the player with an improved feel or a better grip of the paddle.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention

What is claimed is:

1. A sports paddle comprising:

a head portion having a head size within the range of 70 to 100 square inches and including at least one core layer positioned between first and second planar face plates, the first and second face plates having first and second outer surfaces, respectively, the head portion defining a plurality of through-head portion holes extending from the first outer surface to the second outer surface and a plurality of grooves extending into the first and second face plates, the plurality of grooves extending between the plurality of through-head portion holes, the plurality of grooves being spaced apart from the plurality of through-head portion holes, the grooves being elongate with each having a length and a width, and the length of the grooves being greater than the width of the grooves; and a handle portion coupled to the head portion, wherein sports paddle has a maximum longitudinal dimension within the range of 15 to 18 inches measured with respect to a longitudinal axis, wherein the first and second outer surfaces of the first and second face plates define first and second face plate perimeters, respectively, wherein the plurality of grooves do not extend to the first perimeter or to the second perimeter, and wherein the length of each of the plurality of grooves is less than 25 percent of the total length of the sports paddle, wherein a majority of the plurality of grooves extend in a first direction that is substantially parallel to the longitudinal axis.

2. A sports paddle comprising:

a head portion having a head size within the range of 70 to 100 square inches and including at least one core layer positioned between first and second planar face plates, the first and second face plates having first and second outer surfaces, respectively, the head portion defining a plurality of through-head portion holes extending from the first outer surface to the second outer surface and a plurality of grooves extending into the first and second face plates, the plurality of grooves extending between the plurality of through-head portion holes, the plurality of grooves being spaced apart from the plurality of through-head portion holes, the grooves being elongate with each having a length and a width, and the length of the grooves being greater than the width of the grooves; and a handle portion coupled to the head portion, wherein sports paddle has a maximum longitudinal dimension within the range of 15 to 18 inches measured with respect to a longitudinal axis, wherein the first and second outer surfaces of the first and second face plates define first and second face plate perimeters, respectively, wherein the plurality of grooves do not extend to the first perimeter or to the second perimeter, and wherein the length of each of the plurality of grooves is less than 25 percent of the total length of the sports paddle, wherein the plurality of grooves extend in a second direction that is substantially orthogonal to the longitudinal axis.

3. A sports paddle comprising:

a head portion having a head size within the range of 70 to 100 square inches and including at least one core layer positioned between first and second planar face plates, the first and second face plates having first and second outer surfaces, respectively, the head portion defining a plurality of through-head portion holes extending from the first outer surface to the second outer surface and a plurality of grooves extending into the first and second face plates, the plurality of grooves extending between the plurality of through-head portion holes, the plurality of grooves being spaced apart from the plurality of through-head portion holes, the grooves being elongate with each having a length and a width, and the length of the grooves being greater than the width of the grooves; and a handle portion coupled to the head portion, wherein sports paddle has a maximum longitudinal dimension within the range of 15 to 18 inches measured with respect to a longitudinal axis, wherein the first and second outer surfaces of the first and second face plates define first and second face plate perimeters, respectively, wherein the plurality of grooves do not extend to the first perimeter or to the second perimeter, and wherein the length of each of the plurality of grooves is less than 25 percent of the total length of the sports paddle, wherein the plurality of grooves includes at least one groove extending in a first direction that is substantially parallel to the longitudinal axis and at least one groove extending in a second direction that is substantially orthogonal to the longitudinal axis.

4. The sports paddle of claim 1, wherein at least a portion of each of the first and second outer surfaces includes a grit.

5. The sports paddle of claim 1, wherein the plurality of through-head portion holes includes a number of through-head portion holes within the range of 45 to 87 holes.

6. The sports paddle of claim 1, wherein the first face plate and the second face plate have the same pattern of grooves and holes.

7. The sports paddle of claim 1, wherein a majority of the plurality of grooves extend in a first direction that is substantially parallel to the longitudinal axis, and wherein the plurality of grooves includes at least one groove extending in a third direction that is angled with respect to the longitudinal axis.

8. The sports paddle of claim 1, wherein the plurality of grooves have a maximum depth within the range of 0.1 to 10 millimeters, and wherein each of the grooves of the plurality of grooves has a width within the range of 1 to 6 millimeters.

9. The sports paddle of claim 1, wherein the plurality of grooves have a maximum depth within the range of 0.5 to 10 millimeters.

10. The sports paddle of claim 1, wherein the plurality of grooves have a length within the range of 0.5 inches to 10 inches.

11. The sports paddle of claim 1, wherein the head portion further comprises a rim extending about the perimeter of the head portion.

12. The sports paddle of claim 1, wherein sports paddle has a weight within the range of 300 to 420 grams.

13. A sports paddle extending about a longitudinal axis, the paddle comprising:

a generally planar head portion having a head size within the range of 70 to 100 square inches and including at least one core layer positioned between first and second planar face plates, the first and second face plates having first and second outer surfaces, respectively, the head portion defining a plurality of through-head portion holes extending from the first outer surface to the second outer surface and a plurality of grooves extending into the first and second face plates, the plurality of grooves extending between the plurality of through-head portion holes, the plurality of grooves being spaced apart from the plurality of through-head portion holes, the grooves being elongate with each having a length and a width, and the length of the grooves being greater than the width of the grooves, each of the first and second outer surfaces including a generally planar, roughened region and a generally smooth region, the head portion having a rounded shape and a head size within the range of 70 to 100 square inches, the head portion defining a plurality of through-head portion holes extending from the first outer surface to the second outer surface, the planar smooth region of the head portion being formed without a through-head hole and without a groove; and a handle portion coupled to the head portion and including a grip, the smooth region of the first outer surface spacing apart the grip from the roughened region of the first outer surface, the smooth region of the first outer surface having a first longitudinal dimension measured with respect to the longitudinal axis within the range of 1 to 3 inches, wherein sports paddle has a maximum longitudinal dimension within the range of 15 to 18 inches measured with respect to a longitudinal axis, wherein the first and second outer surfaces of the first and second face plates define first and second face plate perimeters, respectively, wherein the plurality of grooves do not extend to the first perimeter or to the second perimeter, and wherein the length of each of the plurality of grooves is less than 25 percent of the total length of the sports paddle, wherein a majority of the plurality of grooves extend in a first direction that is substantially parallel to the longitudinal axis.

14. The sports paddle of claim 13, wherein the roughened regions of each of the first and second outer surfaces includes a grit.

15. The sports paddle of claim 13, wherein the plurality of through-head portion holes includes a number of through-head portion holes within the range of 45 to 87 holes.

16. The sports paddle of claim 13, wherein the through-head portion holes are defined only within the roughened regions of the first and second outer surfaces.

17. The sports paddle of claim 16, wherein the roughened region terminates within 0.25 inches from the through-head portion hole positioned closest to the handle portion.

18. The sports paddle of claim 13, wherein sports paddle has a weight within the range of 300 to 420 grams.

19. The sports paddle of claim 1, wherein the plurality of grooves extend across less than 10% of the head size of each of the first and second face plates of the head portion.

* * * * *